United States Patent [19]

Rosenblum

[11] 3,958,675

[45] May 25, 1976

[54] GARMENT CARRIER

[76] Inventor: Julia R. Rosenblum, 6 W. 77th St., New York, N.Y. 10024

[22] Filed: Apr. 22, 1974

[21] Appl. No.: 463,158

[52] U.S. Cl. ..... 190/43; 190/41 B; 190/41 Z

[51] Int. Cl.[2] ..... A45C 7/00

[58] Field of Search ..... 190/43, 41 B, 41 Z; 206/286, 287; 312/6

[56] References Cited

UNITED STATES PATENTS

| | | | |
|---|---|---|---|
| 1,982,166 | 11/1934 | Hultquist | 190/41 B |
| 2,561,841 | 7/1951 | Cart | 190/43 |
| 2,606,636 | 8/1952 | Braverman | 190/43 |
| 2,689,631 | 9/1954 | Marks | 190/43 |
| 2,774,450 | 12/1956 | Smallberg | 190/43 |

FOREIGN PATENTS OR APPLICATIONS

| | | | |
|---|---|---|---|
| 1,043,823 | 6/1953 | France | 190/43 |

*Primary Examiner*—George E. Lowrance
*Assistant Examiner*—Ro E. Hart
*Attorney, Agent, or Firm*—Clarence A. O'Brien; Harvey B. Jacobson

[57] ABSTRACT

A garment carrier incorporating a vertically elongated bag carefully constructed of flexible material and provided with a sturdy hanger supporting assembly in the upper end thereof and a supporting handle assembly attached thereto. The bag includes front and rear panels which are spaced from each other by a peripheral wall or gusset with the front panel having double vertical zipper closure means provided therein to enable easy access to the interior of the bag. The bag is foldable and provided with a retaining flap attached to the upper end of the bag for retaining the bag in a folded condition to enable it to be carried and handled in a manner similar to a suitcase or the like. The carrier is provided with a supporting hook which can be concealed interiorly in the bag when being carried or projected upwardly through the top wall thereof for supporting the garment carrier from a supporting hook, rod or the like so that clothes are easily available for use.

5 Claims, 6 Drawing Figures

GARMENT CARRIER

BACKGROUND OF THE INVENTION

1. Field of the Invention

The present invention generally relates to garment carriers in the form of a vertically elongated bag in which a plurality of garments may be supported by hanging from a plurality of clothes hangers provided and oriented within the bag. More particularly, the present invention relates to a garment carrier having means at the upper end of the bag for retaining the garment hangers assembled in relation to a garment hanger supporting bar and a retaining flap for securing the garment carrier in folded condition and forming a garment carrier which will be neat and attractive in appearance and also stable in shape when in folded condition to thereby facilitate the carrying and handling of the garment carrier.

2. Description of the Prior Art

Garment carriers of the type incorporating an elongated flexible bag are well known. However, no other garment carrier employs a supporting hook which is inherent to the design of the garment carrier and always present. The others are separate and may be lost or forgotten, thus rendering the bag impossible to hang for use. No other garment carrier has a double zipper open panel as others have single zipper openings making clothes much less easily accessible. Such devices are usually carried by a person grasping the hook at the upper end of the carrier and positioning the carrier over the shoulder until a location is reached. The separate supporting hook then enables the garment carrier to be hung for use. This is quite inconvenient to persons that are traveling by airplane, trains, buses, boat and the like especially when carrying their own luggage since such travelers normally have other articles of luggage. Also, the hook at the upper end of the garment carrier is rather uncomfortable to grasp.

SUMMARY OF THE INVENTION

The trend in present day luggage is to soft luggage which is less likely to be damaged, less trouble to carry and is more easily "carried on" by people using various types of transportation. Thus, an object of the invention is to provide a garment carrier in the form of a vertically elongated bag constructed of lightweight but strong flexible material and including a reinforcement in the upper end thereof for attachment of a carrying handle on the exterior of the bag and attachment of a garment hanger supporting bar of rigid material on the interior of the bag with an alternatively employed supporting hook being attached to the hanger supporting bar and extendible to a point above the bag for support from a supporting rod, hook or the like.

A further object of the invention is to provide a garment carrier including a retaining member for securing the garment hangers to the garment hanger supporting bar thereby preventing accidental disengagement of the supporting hangers from the supporting hanger bar.

Another object of the invention is to provide a garment carrier in accordance with the preceding objects in which the vertically elongated bag is foldable with the lower end portion of the bag being disposed alongside the upper end portion of the bag with the upper end portion of the bag being provided with a covering and retaining flap which overlies and is secured to the folded lower end portion of the bag to retain the bag in folded condition and to retain the shape thereof so that the folded bag may be carried in a manner generally similar to a suitcase or other hand luggage.

Still another object of the present invention is to provide a garment carrier constructed of lightweight flexible material which is attractive in appearance, serviceable and durable, and easy to carry or handle.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a perspective view of the garment carrier in its unfolded condition illustrating the manner in which it may be supported from a rod, hook or the like.

DESCRIPTION OF THE PREFERRED EMBODIMENT

Figure 1:
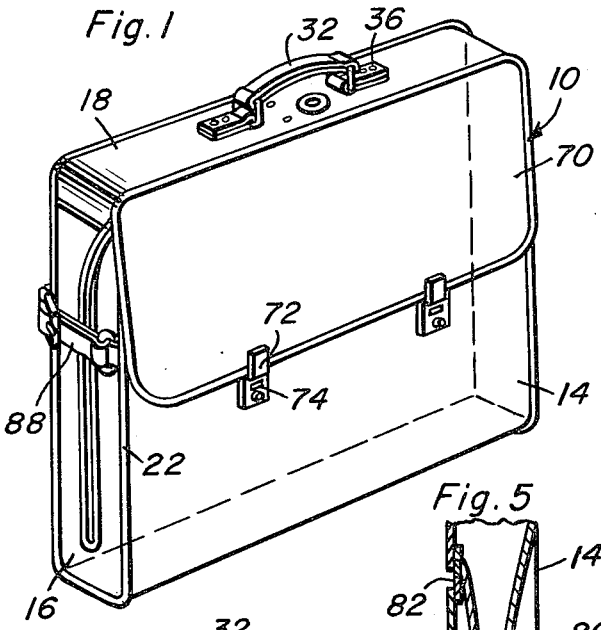
FIG. 1 is a perspective view of the garment carrier of the present invention when in folded condition for carrying in a manner similar to hand luggage.

Referring now specifically to the drawings, the garment carrier of the present invention is generally designated by reference numeral 10 and is in the form of a vertically elongated flexible bag of generally rectangular configuration with the length of the bag being sufficient to receive lightweight garments of a predetermined length. The garment carrier includes spaced panels including a front panel 12 and a rear panel 14 which are of the same shape and size and interconnected by a peripheral wall panel 16 which includes a top wall 18 and a bottom wall 20. The periphery of the peripheral wall panel 16 and the front and rear panels 12 and 14 are secured together by conventional stitching techniques and provided with a ribbed member 22 in the seam in which the seam is generally designated by numeral 24. The panels are constructed of flexible fabric or fabric-like material such as a heavy duty material having any desired external appearance characteristics rendering the device not only serviceable and long-lasting but also attractive in appearance.

Disposed in underlying relation to the top wall panel 18 is a reinforcing strip 26 of the same shape and size as the panel 18. The reinforcing strip is relatively thin and is constructed of suitable material having substantial rigidity but yet being sufficiently flexible to enable some degree of resiliency for the top of the garment carrier. It is noted that the ends of the strip 26 curve downwardly and terminate at the juncture between the top wall panel 18 and the side peripheral panels. The reinforcing strip 26 is secured in place by suitable fastening devices such as rivet type fasteners 30 which have relatively large external heads which also support the carrying handle.

The top wall 18 is provided with a handle member 32 having rectangular loops 34 securing the ends of the handle 32 to mounting straps 36 attached to the top wall 18 and the metal reinforcing strip 26 by suitable fasteners. This construction enables the handle 32 to be oriented in substantially horizontal spaced relation to the top wall 18 or pivoted downwardly in a position generally alongside the top panel 18. The structure of the handle 32 may be of substantially rigid material having some degree of flexibility to facilitate carrying of the garment carrier and generally is similar to carrying handles employed on various types of suitcases or brief cases.

Attached to the reinforcing strip 26 and top wall panel 18 is a hanger supporting bar 38 having upwardly and inwardly extending end portions 40 terminating in and supported by a bracket 42 which may be secured in place by suitable fasteners such as fasteners 30. The bar 38 is spaced downwardly from the reinforcing strip 26 and extends from front to rear of the carrier for supporting a plurality of garment hangers 46 in which the hooks 48 thereon are engaged with the bar 38. The garment hangers 46 may be of lightweight construction and provided to hold suits, trousers, dresses or the like with a skirt or trouser rod or bar 50 on the undersurface thereof together with slot and hook structures 52 facilitating mounting of various types of garments on the hanger 46. The bar 38 is spaced downwardly sufficiently to enable the hooks 48 to be engaged over the bar 38 with the number of hangers supported being varied depending upon the requirements of the person using the carrier.

For retaining the hangers 46 in position, a retaining strap 54 is pivoted on one end portion 40 and is provided with a resilient snap or friction latch or keeper 56 on the other end for releasable engagement with the other end portion 40. The strap 54 overlies the hooks 48 when mounted on the bar 38 thereby avoiding accidental disengagement of the hooks 48 from the bar 38.

For supporting the garment carrier from an overhead support rod or closet rod 58, supporting hook or the like, a chain 60 is attached to the bar 38 and provided with an L-shaped hook 62 on the free end thereof which may be threaded up through a grommet 64 in the strip 26 and top panel 18. The grommet 64 is sufficient in size to permit the free end of hook 62 to be initially inserted up through the grommet and then moved in a manner to thread the remainder of the hook and chain up through the grommet and reversing this process to prepare the bag for carrying after packing.

The front panel 12 of the garment carrier is provided with an openable access panel 66 defined by a pair of parallel zipper assemblies 68 which permit the unattached top edge of the panel 66 to be pulled forwardly and downwardly to provide easy access to the interior of the carrier and to enable the garment hangers and garments to be placed into the carrier or removed therefrom. A covering flap 70 has a top edge connected into the seam joining the front panel 12 and top panel 18 and depends in overlying relation to the top edge of the access panel 66 and also the upper portion of the zippers 68 for retaining the sliders in concealed condition and also concealing the top edge of the access panel 66. The bottom edge of the flap 70 is provided with latch members 72 which are engageable with multiple slot type keepers 74 which may be key locked and are carried by the access panel 66 with the latch elements 72 engaging a selected slot therein for flexibility. The latch 72 and keeper 74 are well known fastener devices employed in various luggage devices, particularly brief cases.

The latches 72 on the flap 70 also serve as a means for retaining the lower end portion of the garment carrier folded upwardly alongside of the upper end portion of the garment carrier as illustrated in FIG. 1 with the latches 72 then engaging keepers 74 which are on the rear panel 14 as illustrated in FIG. 1. In the folded condition, the flap 70 forms a retaining device and concealing device for the bottom of the garment carrier when it is in folded condition as illustrated in FIG. 1. This also provides a structure which simulates the shape and size of a suitcase or similar hand luggage thereby facilitating the carrying thereof.

Figure 5:
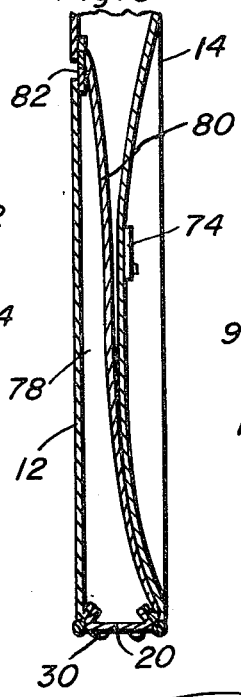
FIG. 5 is a sectional view of the lower portion of the garment carrier illustrating a lower compartment therein.
Figure 6:
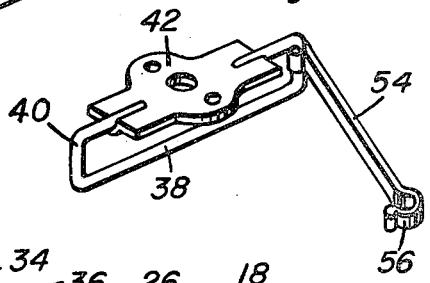
FIG. 6 is a perspective view of the hanger supporting bar.
Figure 3:
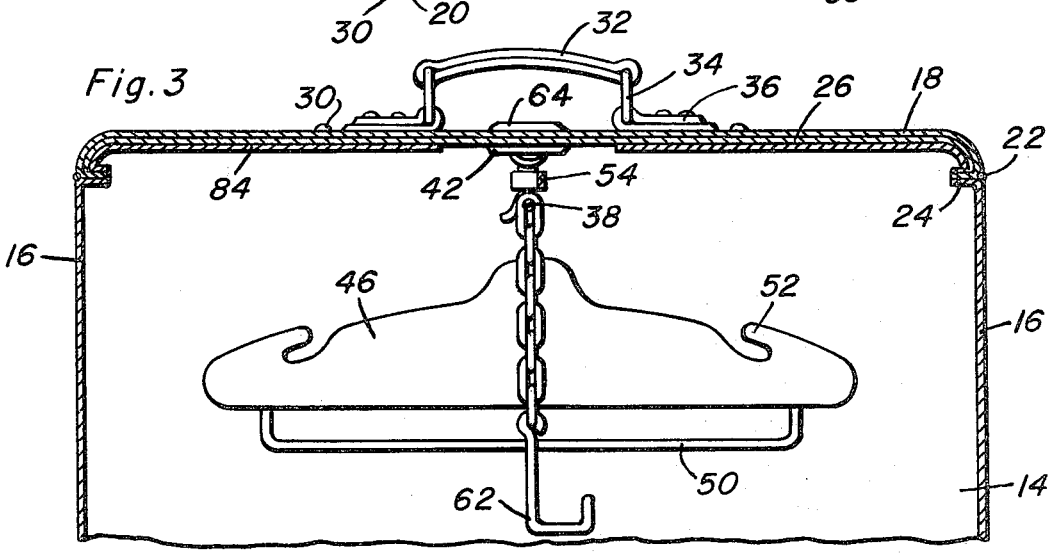
FIG. 3 is a vertical sectional view of the upper end portion of the garment carrier illustrating the handle structure, reinforcing strip, hanger supporting bag and associated structure.

The bottom portion of the garment carrier is provided with a separate lower compartment that is designated by reference numeral 78 in FIG. 5 with the lower compartment being defined by a partition wall 80 that is joined to the front wall 12 immediately above a horizontally disposed zipper 82 and is joined to the rear wall at the seam between the rear wall 14 and the bottom panel 20. This compartment enables storage of small items, shoes or the like which are desired to be maintained separate from the garments supported from the hangers 46.

Figure 2:
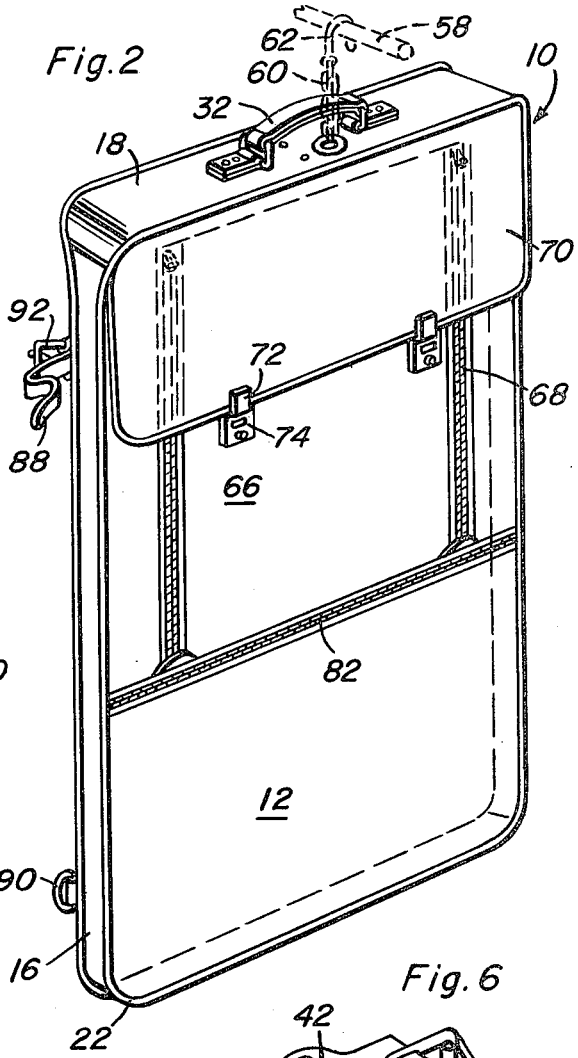
Figure 4:
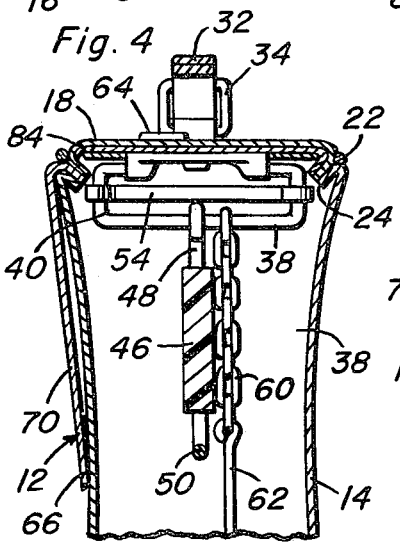
FIG. 4 is a transverse, sectional view of the upper end portion of the garment carrier illustrating further structural details of the structure illustrated in FIG. 3.

The interior of the top of the garment carrier is provided with a liner 84 of fabric material or the like which is secured to the garment carrier at the seam around the top panel. Also, a strap 88, D-ring or loop 90 and buckle 92 are attached to each vertical edge of rear panel 14 as illustrated in FIG. 2 to retain the carrier in its folded conditions as illustrated in FIG. 1.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. A garment carrier comprising a vertically elongated flexible bag including front and rear panels connected by a peripheral wall with the bag being generally rectangular in configuration, handle means attached to the upper end of the garment carrier, the front panel including a closure means openable to enable easy access to the interior of the garment carrier, the top of said garment carrier including a rigid support bar having means thereon for receiving and supporting a plurality of garment hangers, and means at the upper end of the front panel forming a flexible flap, said means forming the flap including a flexible panel having a free lower edge, fastening means adjacent to the lower edge of the flap, said panel overlying and concealing the upper end of the closure means when the garment bag is in unfolded condition and keeper means spaced upwardly from the bottom of the rear panel, said fastening means on the flap being connectable with said keeper means for retaining the garment bag in folded condition with the bottom of the bag disposed under the flap adjacent the top of the bag whereby the handle means enables the garment carrier to be handled in the nature of a suitcase or similar hand luggage.

2. The structure as defined in claim 1 together with a hook attached to said hanger supporting bar by a flexible member, the top of said garment carrier including an opening enabling the hook to be inserted upwardly therethrough for suspending the garment carrier from a support or closet rod.

3. The structure as defined in claim 2 wherein the top of said garment carrier includes a reinforcing strip extending throughout the length and width of the top of the garment carrier with the hanger supporting bar secured thereto and the handle means secured thereto.

4. The structure as defined in claim 3 together with a separate lower compartment in the garment carrier, the front panel having a zipper closure at the upper end of the lower compartment to enable items to be positioned therein, said lower compartment being separated from the remainder of the interior of the garment carrier by a partition wall.

5. The structure as defined in claim 4 wherein said closure means includes a closure panel forming a portion of the front panel, said closure panel being defined by side zippers disposed in spaced parallel relation with the free edge of the closure flap being disposed adjacent to the upper end of the carrier and in underlying relation to the flap attached to the upper end of the carrier to conceal and protect garments being carried.

* * * * *